United States Patent [19]

Adams

[11] Patent Number: 4,836,479

[45] Date of Patent: Jun. 6, 1989

[54] HOSE STORING AND DISPENSING RACK

[76] Inventor: John H. Adams, 1801 21st Ave., Kingsburg, Calif. 93631

[21] Appl. No.: 152,295

[22] Filed: Feb. 4, 1988

[51] Int. Cl.[4] ..... B05B 13/02

[52] U.S. Cl. ..... 248/89; 211/170; 211/100

[58] Field of Search ..... 248/89–93, 248/75, 291, 293, 202.1, 67.7, 309.1; 211/168, 170, 60.1, 100, 89

[56] References Cited

U.S. PATENT DOCUMENTS

| | | | |
|---|---|---|---|
| 1,557,251 | 10/1925 | Hamlin | 248/293 X |
| 2,116,631 | 5/1938 | Jones | 211/100 |
| 2,222,831 | 11/1940 | Bitney | 248/91 |
| 2,602,622 | 7/1952 | Smith | 248/293 |
| 2,647,642 | 8/1953 | Kosash | 211/100 |
| 2,706,049 | 4/1955 | Andrew | 248/293 X |
| 2,848,765 | 8/1958 | Showalter | 248/293 X |
| 3,288,417 | 11/1966 | Wallace | 248/317 |
| 3,941,250 | 3/1976 | Ott | 211/100 X |
| 4,002,369 | 1/1977 | Jennings | 248/188.2 X |

FOREIGN PATENT DOCUMENTS

| | | | |
|---|---|---|---|
| 1831 | of 1910 | United Kingdom | 211/100 |

*Primary Examiner*—Alvin C. Chin-Shue

*Attorney, Agent, or Firm*—Dennison, Meserole, Pollack & Scheiner

[57] ABSTRACT

A hose storage and dispensing rack comprising a U-shaped hose bracket having a close inner end and an open mouth outer end. The close inner end of the bracket pivotally mounts to a generally horizontal base of a bracket support. The bracket support includes a vertical mounting upright with the pivotally mounted hose bracket swinging between a substantially vertical position engaging against the mounting upright, and a substantial horizontal position overlying the support base. The location of the pivotal engagement between the hose bracket and the bracket support allows for a free pivotal movement of the hose bracket between the two positions, and at the same time provides for a gravity-retention of the bracket in each position.

15 Claims, 3 Drawing Sheets

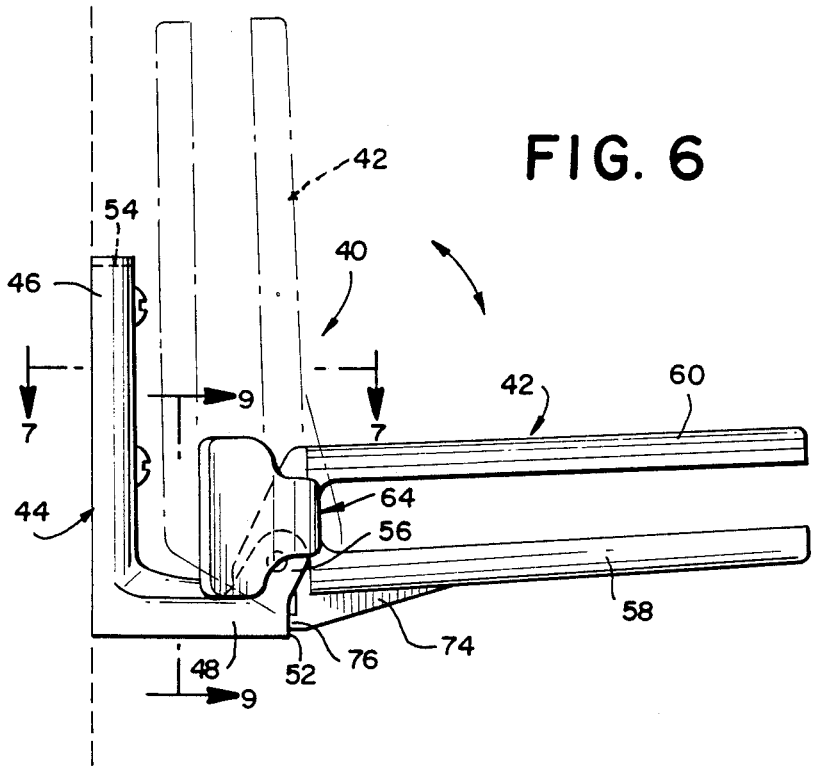
FIG. 6
FIG. 7
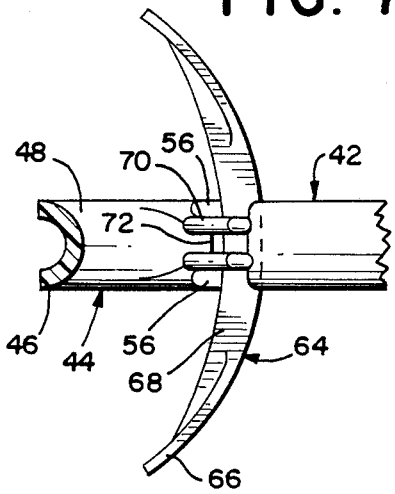
FIG. 8
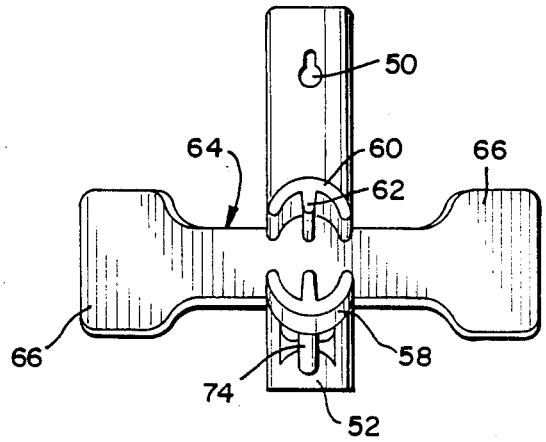
FIG. 9
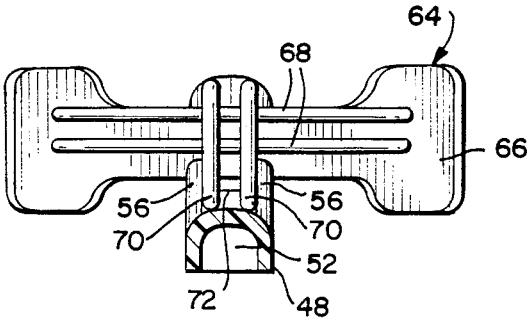

HOSE STORING AND DISPENSING RACK

BACKGROUND OF THE INVENTION

The most common known means for the storage of garden hose and the like between periods of use, other than for a mere coiling of the hose on the ground, has been and is a basic wall-mounted hanger including an arcuate hose-receiving surface.

Such hangers provide an exceptionally convenient compact storage means for hose, the hose easily and rapidly coiling thereon. Patented examples of such hangers were known at least as early as 1910 as exemplified by the following patents;

U.S. Pat. Nos. 955,260, A. Getman, Apr. 19, 1910, 3,029,933, N.J. Sutter, Sept. 26, 1957, 4,436,267, Eads et al., Mar. 13, 1984.

While such hangers easily receive and effectively store coiled hose, they are less than effective, and sometimes extremely bothersome, when it becomes necessary to dispense the hose. In this regard, the hose must either be specifically uncoiled from the hanger or, alternatively, removed therefrom as a unit and placed on the ground for subsequent uncoiling. this latter procedure will frequently result in a substantial tangling and/or kinking of the hose.

Various proposals have been put forth with regard to ways to facilitate the dispensing of hose from storage devices. Two known arrangements will be noted in the following patents:

U.S. Pat. Nos. 832,793 D. B. Jackson, Oct. 9, 1906, 2,334,141, F. P. Zierden, Nov. 9, 1943.

In the patent to Jackson, a hose-retaining lever is automatically actuated upon the introduction of water pressure into the hose to drop the coiled hose to the ground. While this might be advantageous with regard to fire hoses as discussed in Jackson, there appears to be no particular advantage therein for the homeowner over a manual removal of a coiled hose.

In Zierden, a rather elaborate construction is shown involving a rotatably mounted, hose-receiving basket which pivos between a vertical position and a horizontal position with both the coiling and uncoiling of the hose relying on rotation of the basket as the hose is longitudinally fed therein or withdrawn therefrom.

SUMMARY OF THE INVENTION

The present invention involves a hose rack which provides both the coiling convenience of the basic hose hanger, and trouble-free dispensing of the hose directly from the rack by a longitudinal pulling from the nozzle end of the hose.

In order to achieve a construction which uniquely combines the coiling and storage advantages of a fixed hose hanger with an ability to effectively dispense the hose directly from the rack without tangling or kinking, the rack of the invention utilizes a pivotally mounted hose bracket. The hose bracket basically is of a U-shaped configuration with a pair of laterally spaced elongate hose-retaining walls or arms interconnected at one end thereof by a hose seat which includes a transversely elongate and arcing hose saddle with enlarged end portions. The hose bracket, in the storingg position thereof, is generally vertically oriented and upwardly opening. In the hose release or dispensing position, the bracket is pivoted to a lateral, substantially horizontal position, preferably angling upward at a minor degree to the horizontal to prevent uncontrolled slipping of the hose therefrom. In the storing position of the hose bracket, the coils are stacked within the bracket. As the hose bracket moves to the dispensing position thereof, the coils simultaneously shift to a sprially wound suspended position supported by the lowermost bracket wall for a simplified manual withdrawal.

The hose bracket is mounted on a generally L-shaped bracket support which includes an upright adapted to mount to a support surface, for example a wall, and an outwardly extending support base.

In one embodiment the support base is angled slightly upward relative to the horizontal to define the angle of the hose bracket in the dispensing position thereof. The hose bracket is pivotally hinged to the support base of the bracket support rearward of the forward edge thereof to retain an exposed forward end portion of a length sufficient to receive the forward wall or arm of the hose bracket thereagainst for support of the hose bracket in the dispensing position. At the same time, the pivotal mounting of the bracket is spaced sufficiently forward from the vertical wall-engaging mounting upright of the bracket support whereby the hose bracket, in the storing position thereof, swings rearwardly to an "overcenter" position resting against the mounting upright of the bracket or the wall itself with the hose coils rearward of the pivot means. In this manner, the center of gravity of the hose bracket is rearward of the pivot means and the hose bracket is stabilized in its storing position without necessitating special latches, or other mechanical means. At the same time, the hose bracket is easily pivoted to the dispensing position.

In a further embodiment, wherein the hose rack is molded of appropriate synthetic resin, the support base of the bracket support will extend perpendicular to the vertical upright with the upward angling of the bracket in the dispensing position being defined by a depending projection on the bracket engaged against the end of the support base.

For additional strength, both the upright and base of the L-shaped bracket support, and the opposed hose-retaining arms of the bracket, may be molded in a semi-cylindrical configuration, with at least the bracket arms having central reinforcing ribs molded therein.

Formed in the above manner, the hose storing and dispensing rack of the invention is both structurally unique and particularly adapted for both receiving and dispensing hose.

Additional features and advantages of the invention may be noted from the more detailed description of the invention following hereinafter.

BRIEF DESCRIPTION OF THE DRAWINGS

FIG. 6 is a side elevational view of a molded plastic variation of the hose rack of the invention;

FIG. 7 is a partial sectional detail taken substantially on a plane passing along line 7—7 in FIG. 6;

FIG. 8 is a front view of the rack; and

FIG. 9 is a cross-sectional view taken substantially on a plane passing along line 9—9 in FIG. 6.

DESCRIPTION OF PREFERRED EMBODIMENTS

Figure 1:
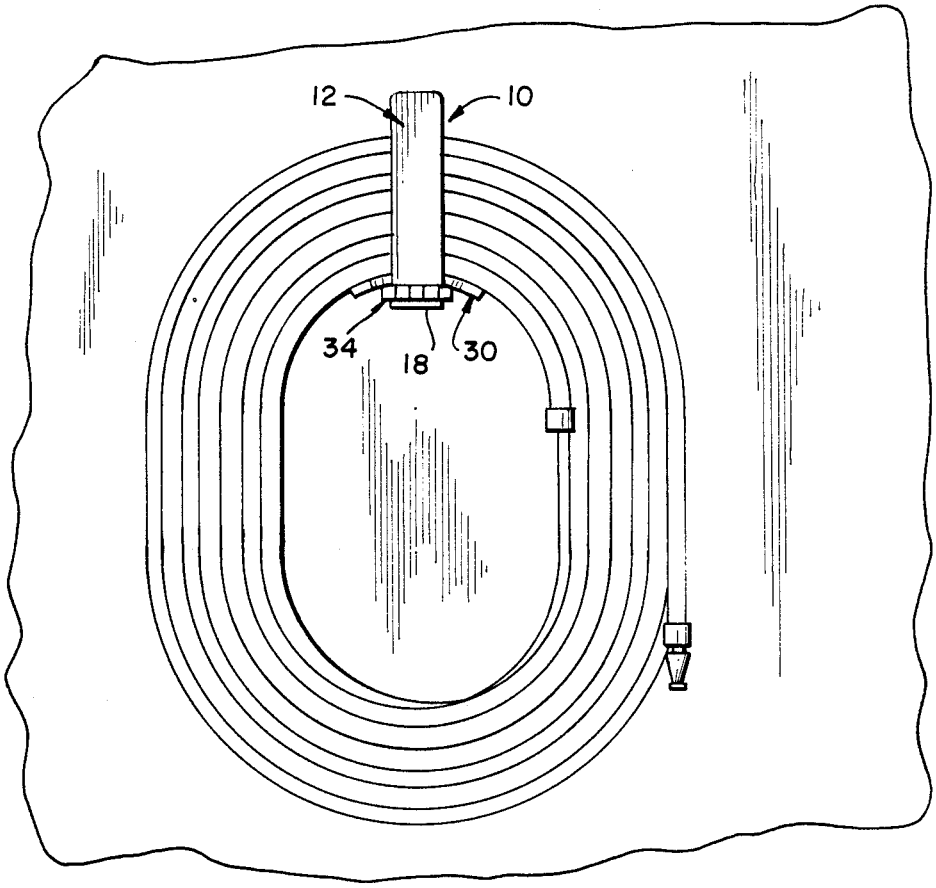
FIG. 1 is a front elevational view of the rack of the invention mounted to a wall surface and with a hose coiled in stored position thereon.

Referring now more specifically to the drawings, and in particular FIGS. 1–5, the hose storing and dispensing rack 10 illustrated therein includes two basic components, the hose bracket 12 and the bracket support 14. The bracket support 14 is of a generally L-shaped configuration including a vertically elongate mounting upright 16 and a laterally extending support base 18 integral or rigidly affixed to the lower end of the mounting upright. Both the upright 16 and base 18 comprise elongate rigid bars. The lateral extension of the support base 18, in the mounted position of the rack 10, is to be slightly upwardly inclined from the horizontal, preferably at 6° thereto as suggested in FIG. 5. Accordingly, as the mounting upright 16 of the bracket support 14 will normally mount to a vertical wall surface, the support base 18 will be oriented approximately 84° to the mounting upright 16. In order to facilitate mounting of the bracket support 14, the mounting upright 16 thereof will incorporate a pair of key-hole slots 20 for sliding engagement over appropriate wall-mounted bolt or screw heads 22.

The hose bracket 12 is basically a U-shaped member having elongate forward and rear bracket walls or arms 24 and 26 interconnected at the inner ends thereof by a bight portion 28, preferably integral with the arms 24 and 26. The bight portion receives thereover and supports a transverse elongate and arcuate hose-receiving saddle 30. The hose saddle 30 is formed of a rigid arcuately formed flat plate which, to the opposite sides of the hose bracket 12, includes laterally enlarged end portions 32. These end portions provide a wider area of support for the hose coils which will naturally tend to spread slightly once beyond the confining bracket arms 24 and 26. Depending upon the nature of the material of the rack, the saddle 30 can be welded to the bight portion 28 if of metal, or integrally molded therewith when formed of a synthetic resinous material.

Figure 5:
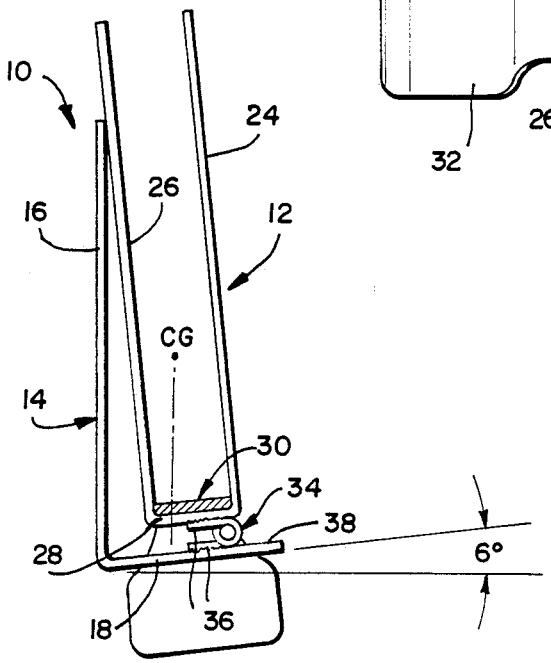
FIG. 5 is a vertical cross-sectional view taken substantially on a plane passing along line 5—5 in FIG. 3.

The hose bracket 12 is pivotally mounted to the laterally extending support base 18 of the bracket support 14 by a hinge 34. The hinge 34 includes a pair of hinge leaves 36 pivoted to a hinge pin and respectively welded or otherwise secured to the undersurface of the bight portion 28 of the hose bracket 12 and the upper surface of the support base 18. The hinge 34 aligns transversely across the support base 18 in rearwardly spaced relation from the free end of the support base 18 to define a support ledge or shoulder portion 38. The hinge also aligns transversely across the forward lower edge of the hose bracket 12 whereby the center of gravity CG of the hose bracket 12, in the upwardly swung vertical storing position thereof, as illustrated in FIG. 5 and in phantom lines at FIG. 2, is rearward of the hinge pivot. In this manner, the bulk of the coiled hose, receive therein as suggested in Figs. 1 and 2, will lay inward of the pivot and effect a biasing of the bracket 12 against either of the upper portion of the vertical upright 16 of the bracket support 14, or the support wall immediately therebehind.

Any tendency for the hose bracket to swing to the dispensing position will be resisted by the weight of the supported hose until such time as the bracket is manually forwardly swung. While the stored position of the hose is stable, pivotal movement of the hose bracket to the dispensing position is easily manually effected with minimal effort.

When in the dispensing position, the forward bracket arm 24 engages the support ledge portion 38 of the support base 18 and projects forwardly therefrom at a slightly upward and forward angle to the horizontal as determined by the angle of the support base 18. Thus, while the hose can be freely drawn from the open mouth of the support bracket by pulling on the leadng or nozzle end of the hose, an accidental discharge or falling of the hose from the bracket is effectively precluded.

Figure 2:
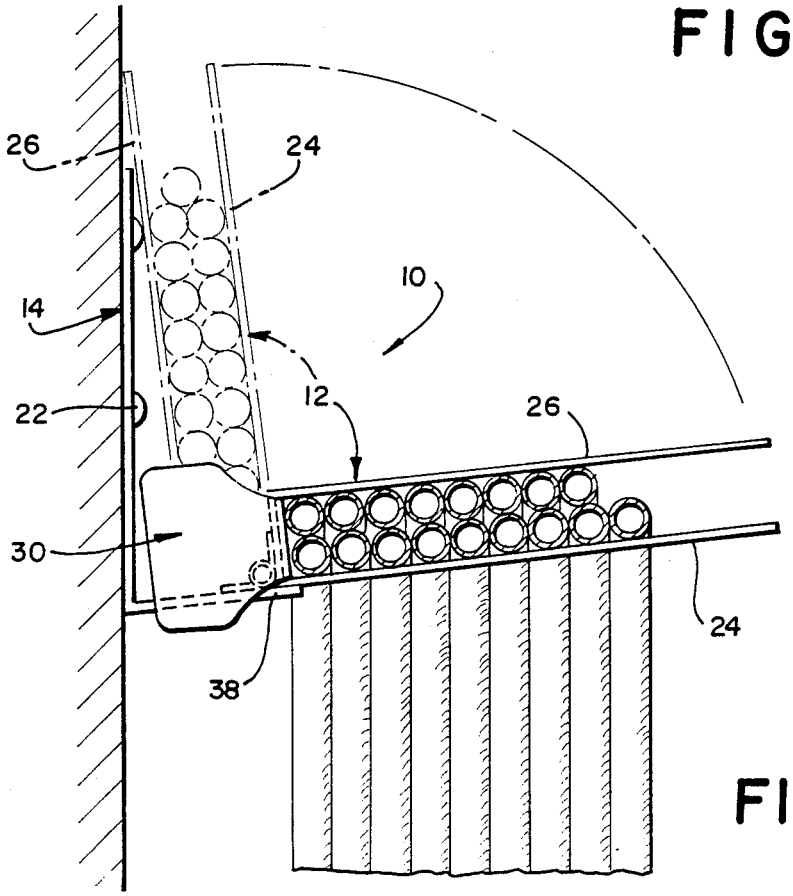
FIG. 2 is an enlarged side elevational view of the wall-mounted rack illustrating the storing position (in phantom lines) and the dispensing position.
Figure 3:
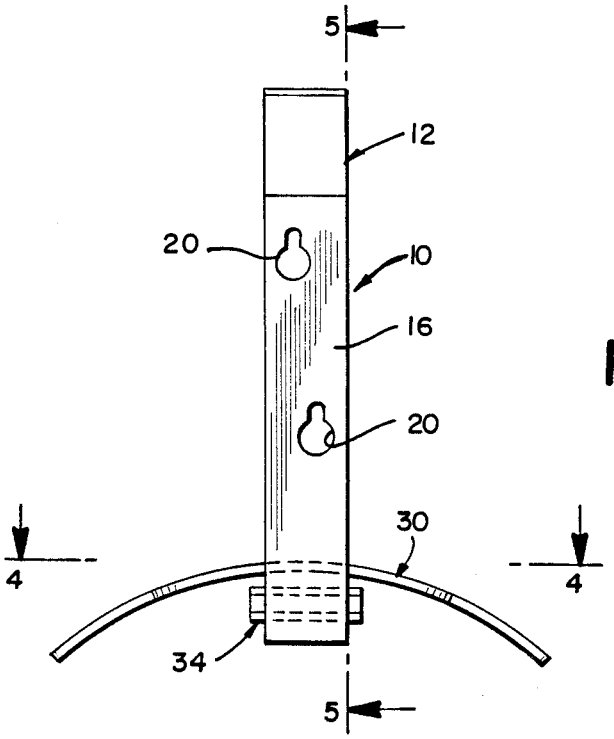
FIG. 3 is a rear elevational view of the rack.
Figure 4:
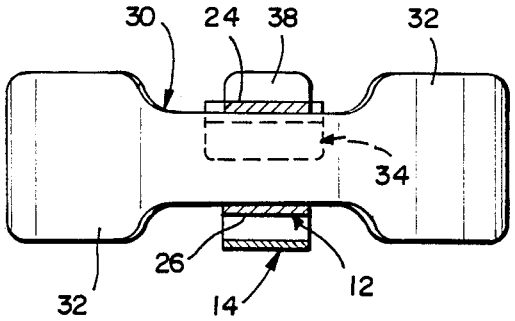
FIG. 4 is a horizontal cross-sectional view taken substantially on a plane passing along line 4—4 in FIG. 3.

Noting FIGS. 1 and 2 in particular, when the hose is to be coiled and stored in the rack, the hose bracket 12 is vertically positioned and the hose coiled therein as in a conventional hose hanger. It will be noted that bracket 12 is relatively narrow between the front and rear arms 24 and 26 thereof, accommodating one or two coil widths whereby the multiple coils stack on each other. Thus, as the hose bracket 12 pivots to the horizontal dispensing position, the coils themselves rotate to maintain a vertical position and assume a generally spiral relationship on the lower forward bracket arm 24 for a sequential unwindng through the open outer end of the bracket, now forwardly directed. After the hose has been removed from the bracket 12, the bracket as desired, can be swung upward to its stored position where, through the rearward positioning of the center of gravity, it will retain itself against the wall or mounting upright 16.

FIGS. 6–9 illustrate a further embodiment wherein the rack 40 is molded by synthetic resin. For example, the hose bracket 42 may be formed of a high impact strength resin such as polycarbonate, or any other suitable high impact resin, while the bracket support 44 may be formed of a glass fiber reinforced nylon.

Noting the cross-sectional details of FIGS. 7 and 9, both the vertically extending mounting upright 46 and the laterally extending support base 48 of the L-shaped support 44 are arcuately formed or of a generally semi-cylindrical configuration for maximum strength and rigidity. The upright 46 incorporates key-hole slots 50 for a mounting thereof to an appropriate wall surface. The laterally extending support base 48 projects perpendicularly to the upright 46 and terminates in a closed, abutment-defining forward end or end wall 52. A similar transverse end wall 54 will close the upper end of the semi-cylindrical upright 46. In order to pivotally accommodate the bracket 42, a pair of vertically projecting laterally spaced ears 56 are integrally molded to the forward end portion of the support base 48.

The forward and rear or lower and upper arms 58 and 60 of the bracket 42 are also arcuately formed about longitudinal axes to define a generally semi-cylindrical configuration for enhanced rigidity. This particular configuration will be best noted in FIG. 8 which also illustrates a full length integral reinforcing rib 62 centrally along the inner arc of each of the arms 58 and 60.

The inner or bight portion of the bracket 42 is integrally molded with the inner ends of the arms 58 and 60 and the transversely arcuate saddle 64. The saddle 64 includes enlarged opposed end portions 66 to the opposite sides of the bracket arms 58 and 60 and is reinforced longitudinally between the opposed ends by a pair of elongate integrally molded reinforcing ribs 68. The bracket 42, and integral saddle 64 are pivotally mounted to the bracket support 44 by means of a pair of lugs 70 integrally molded transversely across the central portion of the saddle 64 whereat the bight portion of the bracket is defined. These lugs project outwardly and are received between the upwardly extending ears 56 of the support base 48 of bracket support 44. An appropriate transverse pivot pin 72 engages between aligned appetures in the ears 56 and lugs 70 for a free pivotal swing of the bracket 42 between the laterally extending dispensing position illustrated in full lines in FIG. 6 and the vertical storing position illustrated in phantom lines.

As will be noted, in the vertical storage position, the center of gravity of the bracket 42 is rearwardly offset from the pivot point defined by the pivot pin 72. The stored hose will thus be positioned in an "over center" position which retains the bracket in a stable stored position until manually forwardly swung.

In the dispensing position, as with the previously described embodiment, it is desirable that the bracket 42 be slightly upwardly inclined to preclude an accidental falling of the hose from the bracket, while at the same time allowing for a free forward drawing of the hose when required. In order to provide for this inclination, the lower or forward arm 58, toward the inner end thereof, is provided with a central depending rib or flange 74 with a rearwardly directed projection or stop 76 which engages against the forward abutment-defining wall 52 of the support base 48 of the bracket support 44. The projection 76 engages the wall 52 at a point whereat the bracket 42, and in particular the lower arm 58 thereof, is at a slight forward upward inclination, for example approximately 6° to the horizontal. As desired, the bracket arms 58 and 60 may slightly converge toward the outer ends thereof, thus enhancing coil retention without inhibiting free manual withdrawal of the hose.

The foregoing is considered illustrative of the principles of the invention. Such obvious variations and modifications as may occur to those skilled in the art are to be considered within the scope of the invention as defined in the claims following hereinafter.

I claim:

1. A hose rack for storing and dispensing a coiled hose, said rack comprising a hose bracket having a closed inner hose-seating end and an opposed open bracket mouth, said hose bracket including forward and rear bracket arms laterally spaced from each other to receive coils of a coiled hose therebetween, and mounting means engaging said bracket at the inner end thereof, said mounting means comprising a generally horizontal support and hinge means mounting said bracket to said support for a swinging movement of the bracket relative to the support between a substantially vertical hose storage position with the bracket mouth uppermost and upwardly opening, and a substantially horizontal hose dispensing position with the forward bracket arm lowermost and with the bracket mouth opening substantially horizontally, said mounting means further comprising a vertical member rigid with said generally horizontal support, said vertical member forming a positiondefining stop receiving the rear bracket arm thereagainst in the hose storage position of the hose bracket, said hose bracket, in the hose storage position, having a center of gravity on a vertical line between the vertical member and the hinge means and being gravity-biased over-center toward engagement with the vertical member for a stored positioning of bracket-received coils laterally between said vertical member and hinge means with the coils encircling the horizontal support, said bracket mouth, in said storage position, being unencumbered for direct vertical access thereto for the introduction of hose coils downwardly therethrough and into said bracket.

2. The rack of claim 1, wherein said hose bracket, in the dispensing position, is gravity-retained in the dispensing position.

3. The rack of claim 2, including a hosereceiving saddle overlying the hose-seating end of the bracket, said saddle extending transversely of the bracket between and beyond the forward and rear arms of the bracket, said saddle having a central portion equal in width to the width of the bracket between the forward and rear bracket arms, said saddle having opposed laterally enlarged outer end portions of greater width than said bracket between said arms for a support of received coils transversely beyond the confinement of the bracket arms.

4. The rack of claim 2, wherein said support extends forward of said hinge means and forms a position-defining support ledge receiving the forward bracket arm thereon in the dispensing position of the hose bracket.

5. The rack of claim 4, wherein said hose bracket, in the dispensing position, is gravity-biased into engagement with the support ledge.

6. The rack of claim 1, including limit means defining the dispensing position of the hose bracket at an acute angle upward from the horizontal.

7. The rack of claim 6, wherein said limit means comprises an abutment defined on the forward end of the support and stop means on the forward bracket arm engaging said abutment in the dispensing position.

8. The rack of claim 7, wherein said stop means comprises a projection on said forward bracket arm inwardly directed toward said abutment.

9. The rack of claim 8, including a hosereceiving saddle at the hose-seating end of the bracket, said saddle extending transversely of the bracket between and beyond the forward and rear arms of the bracket, said saddle having a central portion equal in width to the width of the bracket between the forward and rear bracket arms, said saddle having opposed laterally enlarged outer end portions of greater width than said bracket between said arms for a support of received coils transversely beyond the confinement of the bracket arms.

10. The rack of claim 9, wherein said bracket arms and said saddle are of synthetic resin and integrally molded with each other.

11. The rack of claim 10 wherein said bracket arms are each of a generally semi-cylindrical configuration with an integral rib longitudinally therealong.

12. The rack of claim 10, wherein said hinge means comprises a pair of ears integral with and projecting upward from the generally horizontal support adjacent the forward end thereof, lug means integral with the inner end of the bracket and positioned between said ears, and pin means pivotally mounting said lug means to said ears.

13. The rack of claim 1, including a hose-receiving saddle extending transversely of the bracket between and beyond the forward and rear arms of the bracket, said saddle having a central portion equal in width to the width of the bracket between the forward and rear bracket arms, said saddle having opposed laterally enlarged outer end portions of greater width than said bracket between said arms for a support of received coils transversely beyond the confinement of the bracket arms.

14. A rack for storing and dispensing a coiled hose, said rack comprising a hose bracket and a bracket mount, said bracket mount comprising an angle member with a vertical mounting upright and a forwardly extending lateral support base, said hose bracket comprising a hose-seating inner end, and opposed forward and rear arms extending outward from said inner end for reception of hose coils therebetween, said opposed arms terminating in outer ends forming a hosepassing mouth therebetween, hinge means engaged between the hose bracket inner end and the angle member support base, said hose bracket pivoting about said hinge means between a first upright hose storing position adjacent the vertical mounting upright with the hose-passing mouth upwardly directed for a stacking introduction of hose coils therethrough and a stacked support of the hose coils on the inner end between said opposed arms, and a second generally horizontal dispensing position with the mouth outwardly directed and the forward arm generally paralleling said support base whereby bracket-receiving coils will depend from said forward arm, a hose-receiving saddle extending transversely of the bracket at the hose-seating inner end and between and beyond the forward and rear arms of the bracket, said saddle having a central portion equal in width to the width of the bracket between the forward and rear bracket arms, said saddle having opposed laterally enlarged outer end portions of greater width than said bracket between said arms for a support of received coils transversely beyond the confinement of the bracket arms, and means remote from said mouth for retaining said bracket in said storing position with the mouth unencumbered for introduction of hose coils therethrough.

15. The rack of claim 14, wherein said hose bracket, in the storing position thereof, has a center of gravity on a vertical line between the vertical mounting upright and the hinge means.

* * * * *